US008839773B2

(12) United States Patent
Ellig

(10) Patent No.: US 8,839,773 B2
(45) Date of Patent: Sep. 23, 2014

(54) QUIVER

(76) Inventor: Michael J. Ellig, Bozeman, MT (US)

( * ) Notice: Subject to any disclaimer, the term of this patent is extended or adjusted under 35 U.S.C. 154(b) by 688 days.

(21) Appl. No.: 12/434,523

(22) Filed: May 1, 2009

(65) Prior Publication Data

US 2010/0275896 A1 Nov. 4, 2010

(51) Int. Cl.
*F41B 5/06* (2006.01)

(52) U.S. Cl.
CPC ..... *F41B 5/066* (2013.01)
USPC ..... 124/88

(58) Field of Classification Search
USPC ..... 124/86
See application file for complete search history.

(56) References Cited

U.S. PATENT DOCUMENTS

| | | | | |
|---|---|---|---|---|
| 5,265,584 | A | 11/1993 | Judson et al. | |
| 5,452,703 | A * | 9/1995 | Bateman, III | 124/86 |
| 6,006,734 | A | 12/1999 | Sodaro | |
| 6,105,566 | A * | 8/2000 | Tiedemann | 124/86 |
| 6,672,299 | B2 * | 1/2004 | Proctor | 124/86 |
| 6,845,765 | B1 * | 1/2005 | Allshouse et al. | 124/86 |
| 7,464,908 | B2 * | 12/2008 | Files | 248/229.16 |
| 7,574,811 | B2 * | 8/2009 | Kurtzhals et al. | 33/265 |
| 2006/0065261 | A1 * | 3/2006 | Files | 124/86 |

* cited by examiner

*Primary Examiner* — Gene Kim
*Assistant Examiner* — Amir Klayman
(74) *Attorney, Agent, or Firm* — Husch Blackwell LLP

(57) ABSTRACT

An archery quiver is provided. The quiver includes a hood and an arrow gripper device connected together by at least one stay. A mounting bracket assembly is provided that permits lateral adjustment of the quiver relative to the bow riser. The arrow shaft gripper is provided with cam assemblies with portions that are movable to provide an adjustable gripping force on the arrow shafts.

17 Claims, 4 Drawing Sheets

QUIVER

BACKGROUND OF INVENTION

Quivers for holding and carrying arrows are well known. There are three basic types of quivers. The first type is mounted on the back of an archer and its use and design go back into antiquity. A second type of quiver is carried by an archer on the archer's side and can be suspended from a belt or the like. A third type of quiver can be mounted to a bow and carried with the bow. This latter type of quiver can come in a single piece unit or a two piece unit as is known in the art. The bow mounted quiver typically includes a hood for receipt therein of the arrowhead end of an arrow, an arrow shaft holder and for a single piece unit, a stay having the hood and shaft holder mounted thereto. A mounting bracket is typically provided for mounting the stay to the riser of the bow. Two piece quivers are sometimes mounted to the limbs of the bow particularly in non-cam or non-compound bows.

Oftentimes in use, a quiver is removed from the bow prior to shooting the bow to reduce the potential vibrations and induced torque on the bow during and after shooting of an arrow. Typical quivers can be mounted in an adjustable manner on the bow riser which permits upward and downward movement to adjust the quiver's position on the bow to suit a particular archer's needs and desires. It is common for bow mounted quivers to engage a carried arrow in two positions. This can be done by a single lower mounted arrow shaft gripper device which will retain the lower portion of the arrow in position. The upper part of the arrow can be gripped by a second arrow shaft gripper or the arrowhead can be inserted into a foam insert in the hood to retain the upper portion of the arrow in a fixed position. Hoods are provided with a quiver to prevent accidental contact with a sharp broadhead. If sharp broadheads are not used, a hood could be dispensed with. A typical quiver using two arrow shaft grippers and a hood can be found in U.S. Pat. No. 5,265,584. Another quiver can be found in U.S. Pat. No. 6,006,734. While such quivers have been found to be effective for holding arrows, they still present problems. One particular problem is that an archer may use various types of arrows having different shaft diameters, for example, an aluminum shaft arrow will have a significantly larger diameter than an equivalently spined carbon fiber arrow shaft. The arrow grippers are typically made of an elastomeric material where the resilience of the material is used to accommodate different diameter arrow shafts. Even with the resilience of the material, the grippers have not always been effective in retaining arrows in position in the quiver. An arrow can be released from its mounting in the quiver through vibrations or snags or can move longitudinally exposing the arrowhead if it moves out of the protective confines of the hood.

Thus, there is a need for an improved quiver.

SUMMARY OF INVENTION

The present invention involves the provision of a quiver for mounting on a bow. The quiver includes an arrow holding assembly including a hood with a pocket for receiving arrowheads, an arrow shaft holder for releasably holding a plurality of arrow shafts and at least one stay secured to the hood and arrow holder to connect them together. A mount assembly is provided that cooperates with the arrow holding assembly to mount the arrow holding assembly to a bow. The arrow holding assembly can include first and second brackets with one bracket being adapted to mount on the bow and the other being adapted to connect to the stay(s). The first and second brackets are in cooperative relationship to selectively prevent movement of the brackets relative to one another and to allow the arrow holding assembly to be moved closer to or farther from the bow in side to side position.

The present invention also involves the provision of a vibration dampener that will engage arrow shafts between their gripped areas.

The present invention also involves the provision of an arrow gripper that includes a bracket member with a shaft gripper. The gripper includes a plurality of fingers defining notches for receiving arrow shafts therein. Cam assemblies cooperate with at least some of the fingers and are operable to selectively move a respective finger laterally to decrease or increase size of a respective notch.

Other objects and advantages of the present invention will become apparent from the detailed description.

DETAILED DESCRIPTION OF DRAWINGS

In the accompanying drawings, which form a part of the specification and are to be read in conjunction therewith in which like reference numerals are used to indicate like or similar parts in the various views.

Like numbers throughout the various Figures designate like or similar parts and/or construction.

DETAILED DESCRIPTION OF THE INVENTION

Figure 1:
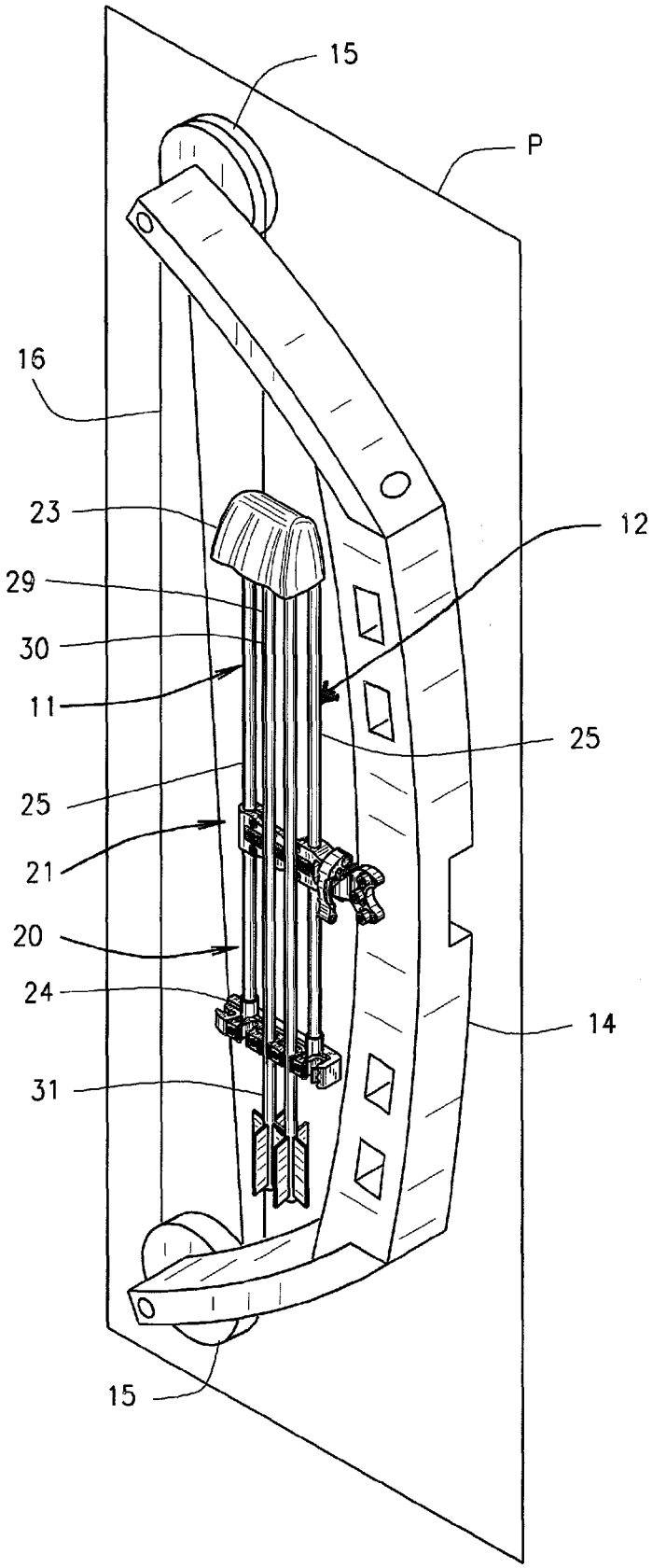
FIG. 1 is a perspective view of a quiver mounted on a compound bow.

The reference numeral 11 designates generally a quiver that is mountable to a bow 12 (FIG. 1) as for example, by attachment to the bow riser 14. The illustrated bow 12 is commonly referred to as a compound bow and uses cams 15 in relation to the bow string and cable system 16. While a compound bow is illustrated, the bow could also be a long bow or a recurve bow or even a crossbow. Compound bows tend to have long risers while recurve and long bows tend to have short risers when made of traditional wood and composite materials. The risers in compound bows tend to be made from a metal alloy and are provided with means for the attachment of such things as quivers and other devices, for example, sights, lights and stabilizers, all of which are known in the art. The bow 12 has a central plane P that passes through the riser 14, limbs 17 and cable system 16 along their longitudinal axes.

Figure 2:
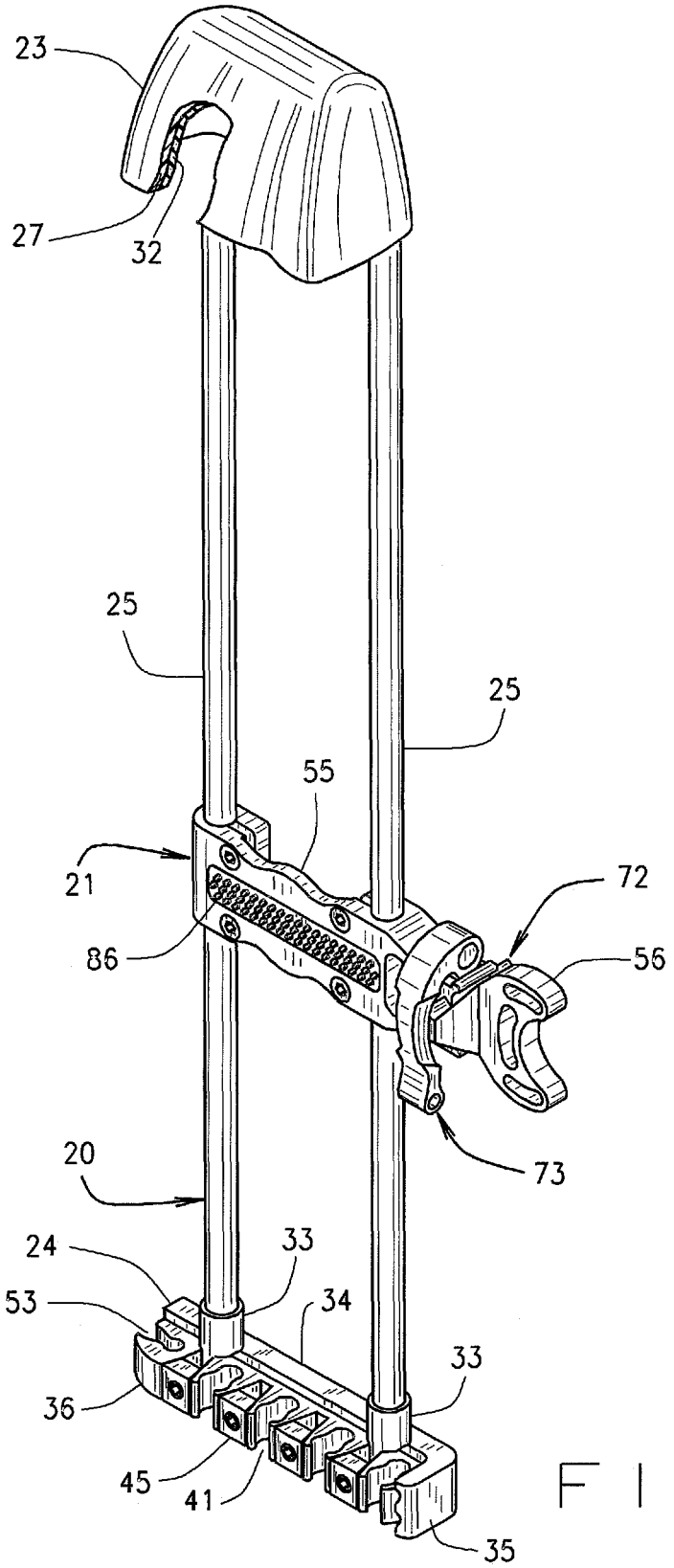
FIG. 2 is an enlarged view of the quiver.

The quiver, as best seen in FIGS. 1, 2 includes an arrow holding assembly designated generally 20 and a mount assembly designed generally 21. The arrow holding assembly 20 is adapted to hold one or more arrows each lying in a plane preferably generally parallel to the plane P. The mount assembly 21 is adapted to removably mount the arrow holding assembly 20 to the bow 12 preferably by attachment to the riser 14. The mount assembly 21 is adapted for allowing movement of the arrow holding assembly 20 side to side on the bow 12, i.e., in a direction generally perpendicular to the plane P, i.e., left or right when viewing the bow from the rear.

As described herein, orientation and movement are as if the bow 12 is in a vertical orientation for shooting as seen in FIG. 1.

The arrow holding assembly 20, in the illustrated structure, includes a hood 23 and an arrow shaft holder 24 which in a one piece quiver are connected together by at least one stay 25 extending between and connected to the hood and shaft holder. The mount assembly 21 is preferably mounted on at least one stay 25 for attachment of the arrow holding assembly 20 to the bow 12.

In the illustrated structure, the hood has a downwardly opening pocket 27 that faces generally toward the arrow shaft holder 24 and is adapted for receipt therein of the arrowhead end 29 of arrows 30. An arrow 30 has a shaft 31 that extends away from the hood 23 toward the arrow shaft holder 24 for releasable securement in the holder 24. The pocket 27 may be provided with an insert 32 such as a closed or open cell foam member for retaining the arrowheads 29 in laterally fixed positions within the pocket 27. The use of a foam insert 32 eliminates the need for a second shaft holder such as that disclosed in U.S. Pat. No. 5,265,584. The hood 23 may be formed of any suitable material such as a molded polymer or a formed metal. The hood 23 may be decorated with a camouflage coating.

In the illustrated structure, the quiver 11 is provided with a pair of stays 25 that are in laterally spaced apart relationship and preferably have generally parallel longitudinal axes. The stays 25 may be made of any suitable material. A preferred material for the stays is a carbon fiber composite tube which provides some flexibility, shock absorption and a resistance to denting as can occur with tubular metal stays. The stays 25 may have a matte finish on the outer surfaces thereof to reduce the likelihood of reflecting light which can be detrimental in a hunting environment. The stays 25 are also preferably flexible to permit sliding of a portion of the mount assembly 21 thereon without binding to provide for up and down adjustment of the arrow holding assembly 20 on the mount assembly 21.

Figure 4:
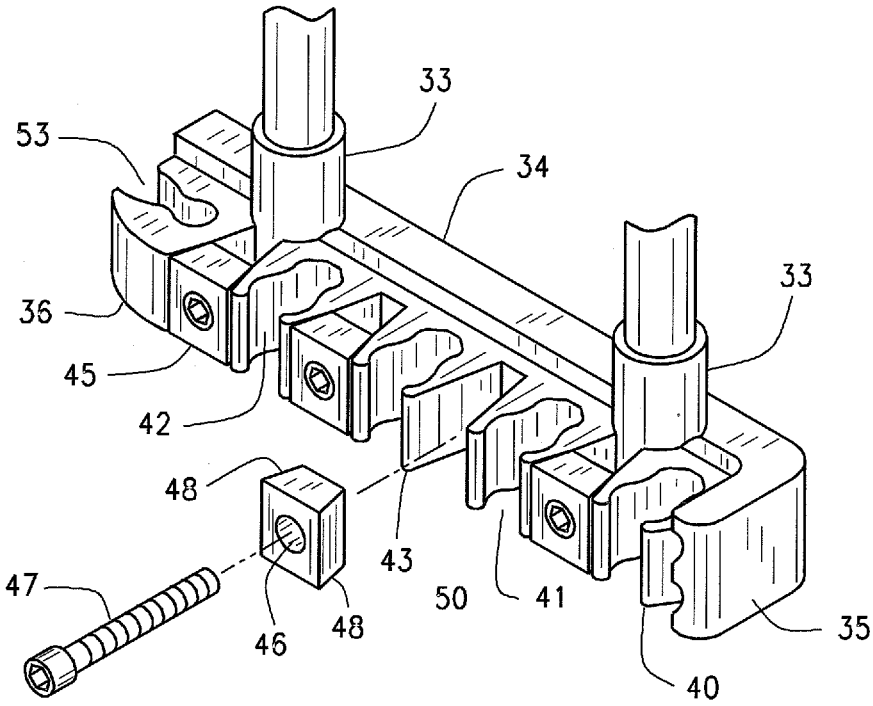
FIG. 4 is an exploded perspective view of the arrow gripper.
Figure 5:
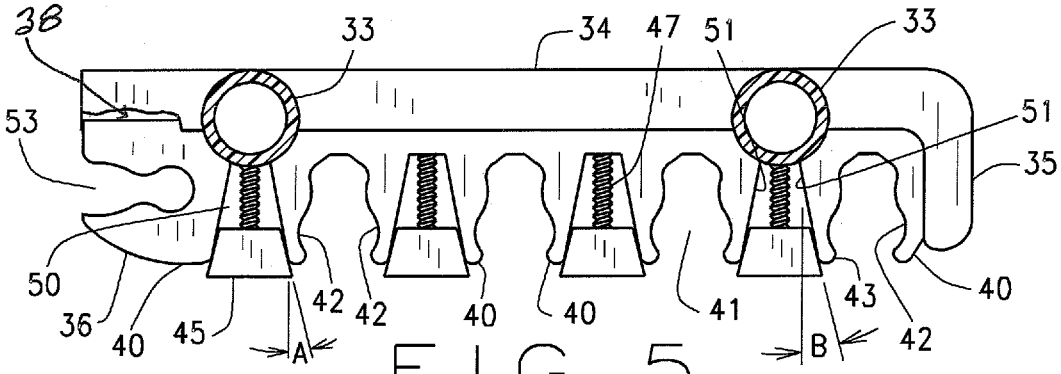
FIG. 5 is a top plan view of the arrow gripper with arrow notches expanded.
Figure 6:
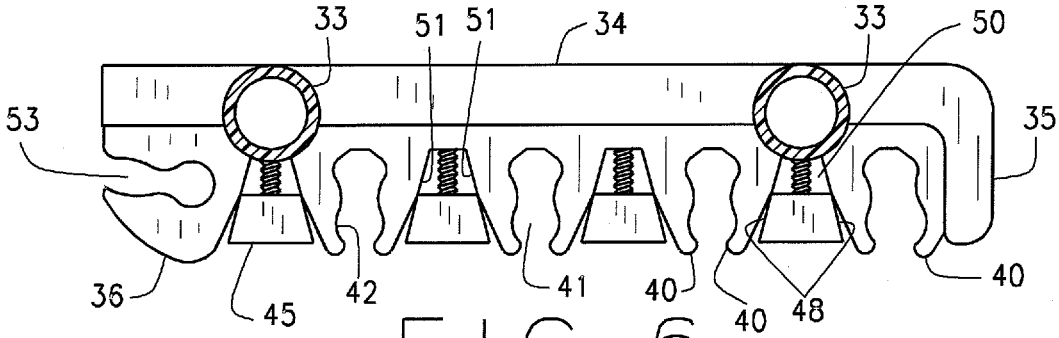
FIG. 6 is a top plan view of the arrow gripper with the arrow notches contracted.

The arrow shaft holder 24, FIGS. 2, 4, has a pair of retainers 33 with bores opening generally toward the hood 23 and are adapted for receipt therein of lower portions of the stays 25 each in a respective retainer 33. Securement of the shaft holder 24 to the stays 25 may be by an adhesive bond. The retainers 33 are preferably part of a bracket 34 with the structure preferably being an integral structure. The bracket 34 and retainers 33 can be of a die cast metal material or a molded polymer. The bracket 34 preferably has an arm portion 35 extending outwardly from the bracket for engagement with a finger 40 of an arrow gripper member 36. The bracket 34 also preferably includes a groove 38, FIG. 5, for assisting in retaining the gripper 36 in secured relationship to the bracket 34 as with adhesive.

The gripper 36 includes a plurality of spaced apart fingers 40 forming notches 41 therebetween. The notches 41 preferably have curved arrow engaging surface portions 42 forming expanded portions in the notches 41 for the receipt in the expanded portions of an arrow shaft 31. The curved surfaces 42 provide a decreased cross sectional width adjacent the free ends 43 of the fingers 40 to assist in retaining the arrow shafts 31 within the respective notch 41.

Means is provide for moving the fingers 40 preferably on opposite sides of a respective notch 41 toward and away from one another to adjust the width of the notches 41 in the spacings between the curved surfaces 42 particularly adjacent the ends 43 of the fingers 40. Cam members 45 are provided and are mounted to the bracket 34 either directly or indirectly and are moveable relative to the fingers 40. In a preferred embodiment, the cam members 45 are movable in a linear manner preferably in a direction generally normal to the longitudinal axes of the notches 41 and arrow shafts 31. Motion inducing devices are associated with the cam members 45 to selectively induce their movement relative to the fingers 40 and to selectively retain the cam members in a selected position relative to a respective finger or fingers 40. In the illustrated structure, the cam members 45 are blocks of material such as a molded polymer having countersunk bores 46 (FIG. 4) therethrough to accept threaded fasteners such as Allen head cap screws therein which screws 47 are threadably engaged with the bracket 34 whereby rotation of a screw 47 will effect movement of a respective cam member at least toward the bracket 34 and loosening of a screw 47 can permit movement of the cam member away from the bracket 34. As shown, the cam members 45 have generally opposed inclined surfaces 48 on opposite sides of the cam member. The cam members 45 are received in slots 50 which have longitudinal axes general parallel to the longitudinal axes of the notches 41. The inclined surfaces 48 engage surfaces 51. The surfaces 51 on opposite sides of a respective slot 50 incline inwardly from the open end to the closed end of the slot 50 and cooperatively interengage the inclined surfaces 48 of a respective cam member whereby movement of a cam member 45 into and out of the slot closes and opens, respectively, at least one notch 41 to adjust its width and increases or decreases the gripping engagement with an arrow shaft 31. As seen, one finger 40 abuts and engages the arm 35 which retains it against lateral movement with the cam member 45 on the other side of the end positioned notch 40 still opening and closing the spacing between the fingers forming the end notch. The cam member 45, by having the inclined surfaces 48, forms a wedge. On the end of the retainer 33, opposite that having the arm 35, there is also provided an arrow shaft gripper notch 53 that opens in a direction generally normal to that of those formed by the fingers 40. The end positioned cam member 45 adjacent the notch 53 can also be used to effect opening and closing movement of the notch 53 to accommodate different desired retention forces and different size arrow shafts. Preferably, the gripper 36 is formed from an elastomeric or polymeric material and preferably has a hardness allowing resilient deformation of the gripper 36 to permit insertion, retention and withdrawal of arrows. While the cam members 45 are shown as having inclined surfaces 48 (angle A) and the surfaces 51 are also inclined (angle B) it is to be understood that the surfaces 48 could be generally parallel while the surfaces 51 can be inclined or the surfaces 51 can be generally parallel and the 48 could be inclined. The angles of inclination A, B (FIG. 5) are preferably in the range of between about 10° and about 30°.

In the illustrated structure, the configuration and orientation of the retainer 33 permits removal and installation of arrows 30 from notches 40 in a direction lateral to the plane P of the bow while the notch 53 permits installation and removal of an arrow 30 in a direction generally parallel to the plane P. The use of independently adjustable cam members 45, permits custom fitting of each notch 41, 53 for a respective arrow permitting simultaneous use of different size arrows 30 with the quiver 11.

The mounting assembly 21 (FIG. 3) includes a plurality of brackets 55, 56. The brackets 55, 56 cooperate to permit selective relative movement therebetween. The bracket 55 is mounted to the arrow holding assembly 20 and the bracket 56 is adapted for mounting to the riser 14 or bowsight of the bow 12. In the illustrated structure, the bracket 55 has a pair of bores 58 each adapted to slideably receive a respective stay 25 therein. As shown, the bores 58 have a generally round transverse cross section. The bores 58 are positioned at opposite ends of the bracket 55 and are each formed by a pair of opposed legs 60 that are joined at a bight section 61. The legs 60 on each end of the bracket are moveable relative to one another and are spaced from one another having a gap 62 therebetween. Threaded fasteners 64 are provided to effect relative movement between a pair of legs 60 to open and close the respective gap 62 to permit or prevent movement of the bracket 55 relative to the stays 25. The fasteners 64 can be, for example, Allen head fasteners. Preferably, the bracket 55 is made of a metal alloy and may be finished on the exterior surface as for example by anodizing or paint. Preferably, the bracket 55 is made of a lightweight metal alloy, for example, an aluminum or magnesium alloy. An extension 65 projects from one end portion 66 of the bracket 55 and has a pair of arms 68 having a gap 69 therebetween adjacent free ends of the arms 68. The gap 69 lies in a plane generally perpendicular to the plane in which the stays 25 lie and the bow plane P.

Figure 3:
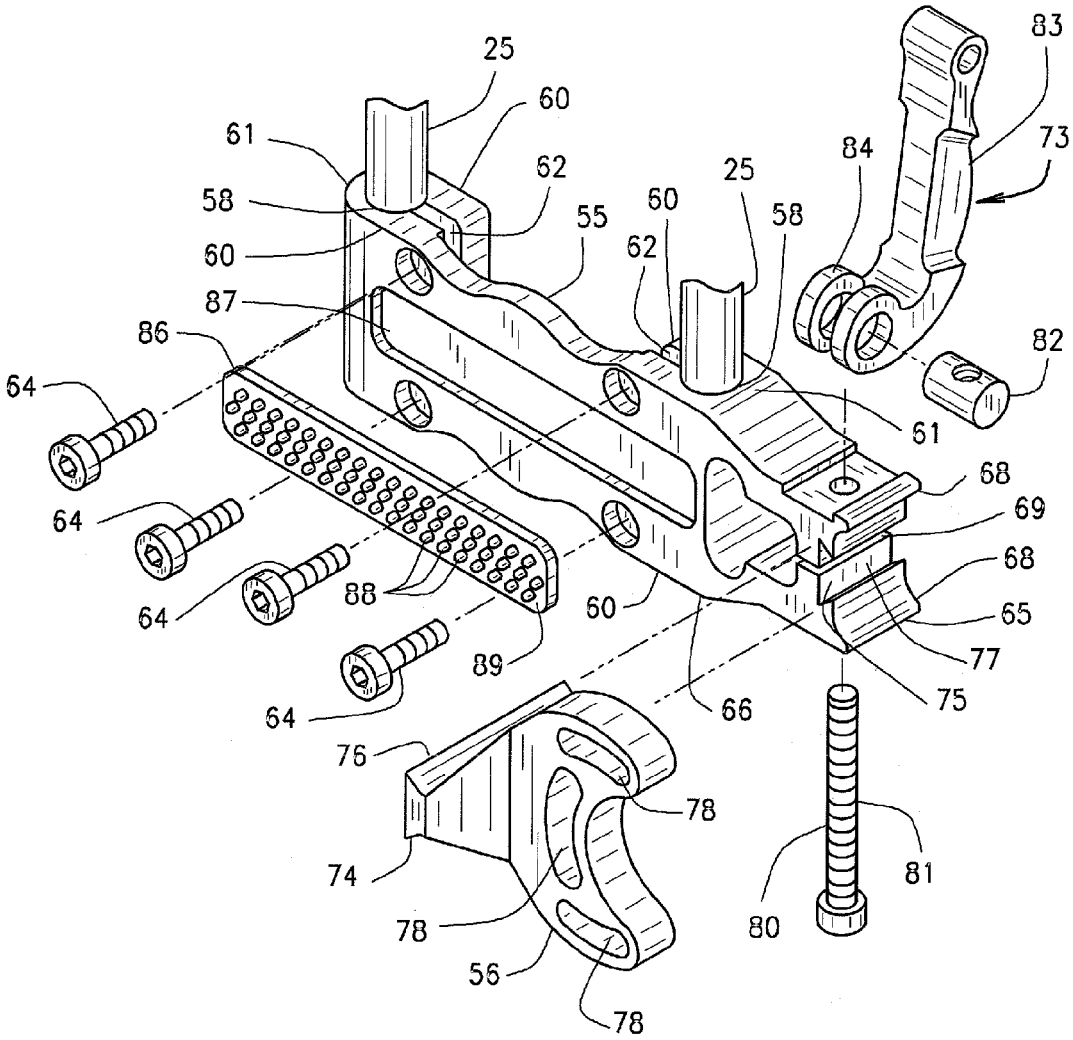
FIG. 3 is an exploded perspective view of a mounting assembly.

The bracket 56 and bracket 55 are mounted to one another for selective movement therebetween such that the arrow holding assembly 20 can be selectively moved side to side relative to the bow plane P. In the illustrated structure, a slide mechanism 72 is provided that permits this lateral movement and a lock mechanism 73 is provided to selectively retain the brackets 55, 56 in a selected position relative to one another whereby the arrow holding assembly can be positioned and retained relative to the bow plane P at a selected lateral position. The slide mechanism 72 is preferably configured to provide a linear slide device allowing generally straight line movement of the bracket 55 relative to the bracket 56. In the illustrated structure, the slide mechanism includes a male portion 74 and a female portion 75 (FIG. 3). In the illustrated structure, the male portion has an elongate male dovetail slide 76 which is received in a female groove 77 where the slide 76 is interlocked within the groove 77 in a manner to permit linear motion therebetween. In the illustrated structure, the slide 76 and groove 77 form a dovetail type slide arrangement. The slide 76 is elongate in the direction of movement as is the groove 77. The bracket 56 is also preferably of a metal alloy material as is the bracket 55 and may also be finished as for example with paint or an anodized exterior finish. The bracket 56 is also provided with means to effect mounting of the quiver 11 and the bracket 56 to the bow riser 14. In the illustrated structure, the bracket 56 is provided with elongate slots 78 for receipt therethrough of fasteners such as screw fastener 79 to mount the bracket 56 to the riser 14. As seen, the slots 78 can be arcuate to permit both forward and rearward positioning of the bracket 56 on the bow riser 14 as well as permitting rotation of the bracket 56 on the riser to permit rotational positioning of the quiver 11 on the riser.

The lock mechanism 73 is operable to selectively lock the brackets 55, 56 at a selected relative position to one another. Preferably, the lock mechanism is easily usable in the field not requiring an auxiliary tool to effect locking or unlocking. The brackets 55 and 56 are adapted for separation to allow removal of the arrow holding assembly 20 from the bow 11. In the illustrated structure, the lock 73 is a cam type locking device. The lock mechanism 73 is operable to effect movement of the arms 68 relative to one another to open and close gap 69 and to move portions of the arms 68 forming the groove 77 toward and away from one another to effect the gripping of surface portions defining the groove 77 on adjacent surfaces of the slide 76. As shown, the lock mechanism 73 includes a shaft member 81 which can be in the form of a threaded fastener such as an Allen head cap screw having a threaded portion extending out of a bore through which the shank member 81 extends. The threaded portion can be engaged with a pivot shaft 82 as by a threaded engagement to permit adjustment of the working length of the threaded shank 80 on the member 81. An arm 83 is mounted on shaft 82 for pivoting relative thereto. The arm 83 has a cam surface 84 which upon rotation or pivoting of the arm 83 changes the distance of the cam surface 84 from the center of rotation of the arm 83 about the shaft 82. This then effects movement of the arms 68 relative to one another to increase or decrease the width of the gap 69 and the surface portions of the groove 77 engaging the slide 76. Preferably, the arm 83 when in a locked position lies close to and overlies the arms 68 (FIG. 3).

In a preferred embodiment, the arrow holding assembly 20 is provided with a device for dampening vibration in arrows 30 secured in the arrow holding assembly 20. As shown, a damper 86 (FIGS. 2, 3) is mounted to the bracket 55 and is movable therewith. The damper 86 can be mounted in a recess 87 and may be secured to the bracket 55 as with an adhesive. In the illustrated structure, the damper 86 has a plurality of protuberances 88. Preferably, the damper 86 and protuberances 88 are made from an elastomeric or polymeric material that can be molded. The hardness of at least the protuberances 88 is such as to be resiliently deformable when engaging and arrow shaft and silently dampen vibration and not deform or scratch the engaged arrow shaft. The protuberance preferably have a length of projection above the surface 89 in the range of between about 1/16th inch and about 3/16th inch and can have a relatively small cross sectional area at their midpoint in the range of between about 0.003 $in^2$ and about 0.027 $in^2$ and occupy about 1/4 to about 3/4 of the protuberance containing area of damper 86. The free ends 90 (not indicated in the drawings apart from the protuberances themselves) of the protuberance 88 are positioned for engaging shafts of the arrows 30 to assist in dampening vibration in the arrows when the bow is shot. Since the damper 86 is secured to the bracket 55, it moves therewith. The free ends 90 of the protuberances 88 lie on a contour substantially the same as the contour of the inside edges of the arrows shafts 31 when they are installed in the quiver 11. In a preferred embodiment, the contour of the free ends 90 is generally planar. It can be curved if desired.

Thus, there has been shown and described several embodiments of a novel invention. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An arrow quiver for mounting on a bow, the quiver including:

an arrow holding assembly including a hood having a pocket for receiving an arrowhead end of an arrow;

an arrow shaft holder with a plurality of arrow shaft receiving notches;

at least one stay secured to and extending between the hood and the holder wherein the pocket opening generally toward the holder; and a mount assembly cooperating with the arrow holding assembly for mounting the arrow holding assembly to a bow, said mount assembly including:

a first bracket connected to the arrow holding assembly, said first bracket including a pair of arms extending from an end portion thereof, said arms defining a groove portion therebetween;

a second bracket mounted to the first bracket for selective movement of said first bracket side to side in a direction generally perpendicular relative to a central plane of said bow and being adapted for reducing torque induced on said bow by said quiver when mounted to a bow by reducing the distance between said quiver and said central plane of said bow, said second bracket including a slide portion, wherein said slide portion is received and interlocked within said groove portion; and a lock mechanism to effect movement of said arms toward and away from one another to effect gripping of said groove portion on said slide portion to selectively permit and prevent relative movement between the first and second brackets and to locate said quiver relative to said central plane of said bow thereby reducing a torque on said bow.

2. The quiver of claim 1 including a damper positioned between said hood and said arrow shaft holder, said damper configured to engage arrow shafts carried in the arrow holding assembly.

3. The quiver of claim 2 wherein the damper being mounted to the first bracket.

4. The quiver of claim 3 wherein the damper including a plurality of outwardly projecting protuberances engaging said arrow shafts.

5. The quiver of claim 4 wherein at least some of the protuberances being of an elastomeric material.

6. The quiver of claim 1 wherein the holder including:

a plurality of fingers defining the notches with cam assemblies cooperating with at least some of the fingers and operable to selectively move a respective finger laterally to decrease or increase size of a respective notch.

7. The quiver of claim 6 wherein at least some of the cam assemblies including wedge members each including a linear motion member to effect movement of a respective wedge member relative to a respective said finger.

8. The quiver of claim 7 wherein the wedge members each having opposed inclined surfaces and the liner motion devices including threaded screws.

9. The quiver of claim 1 wherein the mount assembly wherein said lock mechanism is operable to selectively lock the slide portion at a selected position in the groove portion.

10. The quiver of claim 9 wherein the groove portion being formed by a pair of leg members movable relative to one another and the lock device including a lever with a cam element.

11. The quiver of claim 1 wherein said at least one stay extends in a first direction and said mount assembly extends in a second direction, said second direction substantially perpendicular to said first direction; and said first bracket is slidable relative to said second bracket in a third direction, said third direction being substantially perpendicular to said first direction and said second direction.

12. The quiver of claim 1 wherein said arms further define a gap therebetween and wherein said groove portion is female dovetail groove portion having a generally trapezoidal cross section, the longest side of said trapezoidal cross section facing an interior of said first bracket.

13. The quiver of claim 1 wherein said slide portion has a generally trapezoidal cross section, the longest side of said trapezoidal cross section positioned at a distal end of said second bracket.

14. The quiver of claim 1 wherein said lock mechanism has a cam to effect movement of said arms toward and away from one another.

15. The quiver of claim 1 wherein said lock mechanism is comprised of a fastener, a pivot shaft having a bore through which said fastener extends, and a lever arm having a cam surface, the distance of which varies relative to a center of rotation of said lever arm.

16. The quiver of claim 15 wherein said cam surface engages one of said arms of said first bracket in order to effect movement of that arm when said lever arm is rotated.

17. The quiver of claim 4 wherein said protuberances project generally perpendicular to said central plane.

* * * * *